US005969011A

United States Patent [19]

Frölich et al.

[11] Patent Number: 5,969,011

[45] Date of Patent: Oct. 19, 1999

[54] SIZING OF PAPER

[75] Inventors: Sten Frölich, Askim; Erik Lindgren, Bohus; Rein Sikkar, Floda, all of Sweden

[73] Assignee: Akzo Nobel nv, Arnhem, Netherlands

[21] Appl. No.: 09/017,904

[22] Filed: Feb. 3, 1998

Related U.S. Application Data

[60] Provisional application No. 60/038,431, Feb. 19, 1997.

[30] Foreign Application Priority Data

| | | | |
|---|---|---|---|
| Feb. 5, 1997 | [EP] | European Pat. Off. | 97850016 |
| Feb. 5, 1997 | [EP] | European Pat. Off. | 97850017 |
| Dec. 30, 1997 | [SE] | Sweden | 9704931-6 |

[51] Int. Cl.[6] ..... D21H 17/07; D21H 17/09; D21H 17/16; D21H 17/17

[52] U.S. Cl. ..... 524/35; 524/47; 524/55; 106/287.14; 106/162.2; 106/162.71; 106/162.81; 106/164.3

[58] Field of Search ..... 524/35, 47, 55; 106/287.14, 162.2, 162.71, 162.81, 164.3

[56] References Cited

U.S. PATENT DOCUMENTS 4,964,915 10/1990 Blixt et al. ..... 106/210

OTHER PUBLICATIONS

Nitikin, "The Chemistry of Cellulose and Wood" Academy of Sciences of the USSR, Jerusalem 1966, pp. 62–71.

*Primary Examiner*—Nathan M. Nutter
*Attorney, Agent, or Firm*—Ralph J. Mancini

[57] ABSTRACT

The invention relates to an aqueous dispersion containing a cellulose-reactive sizing agent and a dispersant system comprising a low molecular weight cationic organic compound having a molecular weight less than 10,000 and an anionic stabilizer, its preparation and use in the production of paper. The invention further relates to a substantially water-free composition containing a cellulose-reactive sizing agent, a low molecular weight cationic organic compound having a molecular weight less than 10,000 and an anionic stabilizer, its preparation and use in the preparation of an aqueous dispersion of cellulose-reactive sizing agent.

21 Claims, No Drawings

SIZING OF PAPER

This application claims benefit of provisional application 60/038,431, filed Feb. 19, 1997.

The present invention relates to sizing of paper and more specifically to dispersions of cellulose-reactive sizing agents, their preparation and use.

BACKGROUND

Cellulose-reactive sizing agents, such as those based on alkyl ketene dimer (AKD) and alkenyl succinic anhydride (ASA), are widely used in papermaking at neutral or slightly alkaline stock pH's in order to give paper and paper board some degree of resistance to wetting and penetration by aqueous liquids. Paper sizes based on cellulose-reactive sizing agents are generally provided in the form of dispersions containing an aqueous phase and finely divided particles or droplets of the sizing agent dispersed therein. The dispersions are usually prepared with the aid of a dispersant system consisting of an anionic compound, e.g. sodium lignosulfonate, in combination with a high molecular weight amphoteric or cationic polymer, e.g. cationic starch, polyamine, polyamideamine or a vinyl addition polymer. Depending on the overall charge of the compounds of the dispersant system, the size dispersions will be cationic or anionic in nature. However, dispersions of these types usually exhibit rather poor stability and high viscosity, even at relatively low solids contents, which evidently lead to difficulties in handling the dispersions, for example on storage and in use. A further drawback is that the products have to be supplied as low concentration dispersions which further increases the costs of transportation of the active sizing agent.

Cellulose-reactive sizing agents generally provide good sizing with low dosages of the sizing agent. However, it has been experienced that the efficiency of conventional cellulose-reactive sizing agents is deteriorated when they are used with stocks having a high cationic demand and containing substantial amounts of lipophilic wood extractives, such as, for example, resin acids, fatty acids, fatty esters, triglycerides, etc. Due to the anionic character of lipophilic substances containing carboxylate or carboxylic acid groups, stocks containing substantial amounts of lipophilic extractives usually have a rather high cationic demand. It has been found that the lipophilic substances can be detrimental to the adsorption of sizing agents onto the fibers which may cause the poor sizing results. In order to improve sizing with such stocks the papermaker has had to increase the dosage of sizing agent, which of course is less favourable economically and can increase the accumulation of sizing agent in the white water recirculating in the papermaking process. These problems are even more pronounced in paper mills where white water is extensively recirculated with the introduction of only low amounts of fresh water into the process, thereby increasing the cationic demand and the accumulation of lipophilic extractives and non-retained sizing agent in the white water and the stock to be dewatered.

THE INVENTION

In accordance with the present invention it has been found that improved stability and sizing characteristics can be obtained with aqueous dispersions of cellulose-reactive sizing agents in which the sizing agent is dispersed in the aqueous phase by means of a dispersant system comprising a low molecular weight cationic compound and an anionic stabilizer. The size dispersions of this invention exhibit excellent stability and low viscosity and they are particularly useful with papermaking stocks having a high cationic demand and/or containing high levels of lipophilic substances. It has also been found that improved sizing can be obtained by using such dispersions in papermaking processes where white water is extensively recirculated. More specifically, the present invention relates to an aqueous dispersion containing a cellulose-reactive sizing agent and a dispersant system comprising a low molecular weight cationic organic compound and an anionic stabilizer, its preparation and use, as further defined in the claims.

The present size dispersions makes it possible to produce paper with improved sizing over conventional size dispersions at a corresponding dosage of cellulose-reactive sizing agent and to use a lower dosage of cellulose-reactive sizing agent to attain a corresponding level of sizing. The possibility of using lower amounts of sizing agent to attain in-specification sizing reduces the risk of accumulation of nor-adsorbed sizing agents in the white water recirculating in the process, thereby reducing the risk of aggregation and deposition of the sizing agent on the paper machine. The present invention thus offers substantial economic and technical benefits.

The cellulose-reactive sizing agent according to the invention can be selected from any of the cellulose/reactive sizing agents known in the art Suitably the sizing agent is selected from the group consisting of hydrophobic ketene dimers, ketene multimers, acid anhydrides, organic isocyanates, carbamoyl chlorides and mixtures thereof, preferably ketene dimers and acid anhydrides, most preferably ketene dimers. Suitable ketene dimers have the general formula (I) below, wherein $R^1$ and $R^2$ represent saturated or unsaturated hydrocarbon groups, usually saturated hydrocarbons, the hydrocarbon groups suitably having from 8 to 36 carbon atoms, usually being straight or branched chain alkyl groups having 12 to 20 carbon atoms, such as hexadecyl and octadecyl groups. Suitable acid anhydrides can be characterized by the general formula (II) below, wherein $R^3$ and $R^4$ can be identical or different and represent saturated or unsaturated hydrocarbon groups suitably containing from 8 to 30 carbon atoms, or $R^3$ and $R^4$ together with the —C—O—C— moiety can form a 5 to 6 membered ring, optionally being further substituted with hydrocarbon groups containing up to 30 carbon atoms. Examples of acid anhydrides which are used commercially include alkyl and alkenyl succinic anhydrides and particularly isooctadecenyl succinic anhydride.

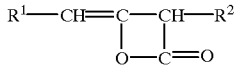

(I)

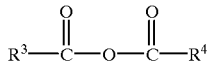

(II)

Suitable ketene dimers, acid anhydrides and organic isocyanates include the compounds disclosed in U.S. Pat. No. 4,522,686, which is hereby incorporated herein by reference. Examples of suitable carbamoyl chlorides include those disclosed in U.S. Pat. No. 3,887,427 which is also incorporated herein by reference.

In addition to the cellulose-reactive sizing agent, the size dispersions may also contain a non-cellulose-reactive sizing agent. Examples of suitable sizing agents of this type include rosins, e.g. fortified and/or esterified rosin, waxes, fatty acid and resin acid derivatives, e.g. fatty amides and fatty esters, e.g. glycerol triesters of natural fatty acids.

The dispersions of this invention contain a dispersant, or dispersant system, comprising a cationic organic compound and an anionic stabilizer. The compounds are preferably bound together by the force of electrostatic attraction, thereby representing a coacervate dispersant When used in combination, these compounds are effective as a dispersant for the sizing agent although the cationic compound and/or the anionic compound do not have to be effecive as a dispersant when used singly. Particularly preferred dispersions of this invention include those containing a cationic surfactant and an anionic stabilizer, as defined hereinafter. In a preferred embodiment of the invention, the dispersion is anionic, i.e. the dispersant system has an overall anionic charge.

The cationic compound contains one or more cationic groups of the same or different types and include cationic compounds having one cationic group and cationic compounds having two or more cationic groups, i.e. cationic polyelectrolytes. Examples of suitable cationic groups include sulfonium groups, phosphonium groups, acid addition salts of primary, secondary and tertiary amines or amino groups and quaternary ammonium groups, for example where the nitrogen has been quaternized with methyl chloride, dimethyl sulfate or benzyl chloride, preferably acid addition salts of amines/amino groups and quaternary ammonium groups. Cationic polyelectrolytes can have a degree of substitution varying over a wide range; the degree of cationic substitution ($DS_C$) can be from 0.01 to 1.0, suitably from 0.1 to 0.8 and preferably from 0.2 to 0.6.

Suitable cationic organic compounds for use in this invention include cationic compounds capable of functioning as a surfactant and/or dispersing agent and/or coupling agent between the particle or droplet of sizing agent and the anionic stabilizer. Preferably the cationic compound is a surfactant Preferred cationic surfactants include compounds having the general formula $R_4N^+X^-$, wherein each R group is independently selected from (i) hydrogen; (ii) hydrocarbon groups, suitably aliphatic and preferably alkyl groups, having from 1 to about 30 carbon atoms, preferably from 1 to 22 carbon atoms; and (iii) hydrocarbon groups, suitably aliphatic and preferably alkyl groups, having up to about 30 carbon atoms, preferably from 4 to 22 carbon atoms, and being interrupted by one or more heteroatoms, e.g. oxygen or nitrogen, and/or groups containing a heteroatom, e.g. carbonyl and acyloxy groups; where at least one, suitably at least three and preferably all of said R groups contain carbon atoms; suitably at least one and preferably at least two of said R groups containing at least 7 carbon atoms, preferably at least 9 carbon atoms and most preferably at least 12 carbon atoms; and wherein $X^-$ is an anion, typically a halide like chloride, or an anionic group present in the anionic compound of the dispersant, e.g. where the surfactant is a protonated amine of the formula $R_3N$ wherein R and N are as defined above. Examples of suitable surfactants include dioctyldimethylammonium chloride, didecyldimethylammonium chloride, dicocodimethylammonium chloride, cocobenzyldimethylammonium chloride, coco(fractionated) benzyldimethylammonium chloride, octadecyl trimethylammonium chloride, dioctadecyl dimethylammonium chloride, dihexadecyl dimethylammonium chloride, di(hydrogenated tallow)dimethylammonium chloride, di(hydrogenated tallow)benzylmethylammonium chloride, (hydrogenated tallow)benzyldimethylammonium chloride, dioleyldimethylammonium chloride, and di(ethylene hexadecanecarboxylate)dimethylammonium chloride. Particularly preferred cationic surfactants thus include those containing at least one hydrocarbon group with from 9 to 30 carbon atoms and notably quaternary ammonium compounds.

Further preferred cationic surfactants include quaternary di- and polyammonium compounds containing at least one hydrocarbon group, suitably aliphatic and preferably alkyl, with from 9 to 30 carbon atoms, preferably from 12 to 22 carbon atoms. Examples of suitable surfactants of this type include N-octadecyl-N-dimethyl-N'-trimethylpropylenediammonium dichloride.

Preferred cationic polyelectrolytes further include low molecular weight cationic organic polymers, optionally degraded, e.g. those derived from polysaccharides like starches and guar gums, cationic condensation products like cationic polyurethanes, polyamideamines, e.g. polyamideamine-epichlorohydrin copolymers, polyamines, e.g. dimethylamine-epichlorohydrin copolymers, dimethylamine-ethylenediamine-epichlorohydrin copolymers, ammonia-ethylenendichloride copolymers, vinyl addition polymers formed from monomers with cationic groups, e.g. homopolymers and copolymers of diallyldimethylammonium chloride, dialkylaminoalkyl acrylates, methacrylates and acrylamides (e.g. dimethylaminoethyl acrylates and methacrylates) which usually are present as acid addition salts or quaternary ammonium salts, optionally copolymerized with non-ionic monomers including acrylamide, alkyl acrylates, styrene and acrylonitrile and derivatives of such monomers, vinyl esters, and the like.

The molecular weight of the cationic organic compound generally can be up to about 10,000, usually up to about 5,000, suitably up to about 3,000 and preferably up to about 800. The molecular weight is usually at least about 200. Suitable cationic surfactants may have a molecular weigtht up to about 3,000 and preferred cationic surfactants have a molecular weight between about 200 and about 800.

Suitable anionic stabilizers for use in this invention include anionic compounds functioning as stabilizers and/or being effective in combination with the cationic compound to stabilize the sizing agent in an aqueous phase as well as anionic compounds known as useful as dispersants in the preparation of size dispersions. Preferably the anionic compound is water-soluble or water-dispersable. The anionic stabilizer can be can be selected from organic or inorganic compounds and it can be derived from natural or synthetic sources. The anionic stabilizer of the dispersant system contains one or more anionic groups of the same or different types and include anionic compounds having one anionic group and anionic compounds having two or more anionic groups, herein referred to as an anionic polyelectrolyte. The term anionic polyelectrolyte is meant to include also anionic compounds acting as a polyelectrolyte, e.g. through chemical non-ionic interaction or attraction. In a preferred embodiment, the anionic stabilizer is an anionic polyelectrolyte. Examples of suitable anionic groups, i.e. groups that are anionic or rendered anionic in water, include phosphate, phosphonate, sulphate, sulphonate, sulphonic acid and carboxylic acid groups and salts thereof, usually ammonium or alkali metal (generally sodium) salts. The anionic groups can be native or introduced by means of chemical modification in known manner. The anionic stabilizer can have a degree of anionic substitution ($DS_A$) varying over a wide range; the $DS_A$ can be from 0.01 to 1.4, suitably from 0.1 to 1.2 and preferably from 0.2 to 1.0. Anionic polyelectrolytes may contain one or more cationic groups as long as it has an overall anionic charge.

In a preferred embodiment, the anionic stabilizer is selected from organic compounds. Suitable anionic stabilizers of this type include polymeric compounds such as those based on polysaccharides like starches, guar gums, celluloses, chitins, chitosans, glycans, galactans, glucans, xanthan gums, mannans, dextrins, eta, preferably phosphated, sulphonated and carboxylated polysaccharides, as well as synthethic organic polymers like condensation products, e.g. anionic polyurethanes and polymeric anionic compounds based on naphthalene, e.g. condensated naphthalene sulphonates, and further vinyl addition polymers formed from monomers with anionic groups, e.g. acrylic acid, methacylic acid, maleic acid, itaconic acid, crotonic acid, vinylsulfonic acid, sulfonated styrene and phosphates of hydroxyalkyl acrylates and methacrylates, optionally copolymerized with non-ionic monomers including acrylamide, alkyl acrylates, styrene and acrylontrile as well as derivatives of such monomers, vinyl esters, and the like. Particularly preferred organic anionic stabilizers include anionic polysaccharides, e.g. cellulose-derivatives like carboxymethyl celluloses, condensated naphthalene sulfonates, anionic acrylamide-based polymers and polymers based on acrylic acid and similar acid monomers.

In a preferred embodiment of the invention, the anionic stabilizer is hydrophobe-modified and contains one or more hydrophobic groups, suitably being a hydrophobically modified polysaccharide, preferably carboxymethyl cellulose. Examples of suitable groups include hydrophobic substituents containing from 4 to about 30 carbon atoms, notably hydrophobic amide, ester and ether substituents comprising a saturated or unsaturated hydrocarbon chain of at least 4 and preferably from 8 to 30 carbon atoms, optionally being interrupted by one or more heteroatoms, e.g. oxygen or nitrogen, and/or groups containing a heteroatom, e.g. carbonyl or acyloxy. Suitable anionic polysaccharides, anionic hydrophobically modified polysaccharides and methods of introducing hydrophobic substituents into polysaccharides are for example disclosed in U.S. Pat. No. 4,687,519 and International Pat. Publ. No. WO 94/24169, which are hereby incorporated herein by reference.

In another preferred embodiment, the anionic stabilizer is selected from inorganic anionic materials, preferably anionic inorganic polyelectrolytes such as, for example, compounds containing silicon atoms, e.g. various forms of condensated or polymerized silicic acid which have negative hydroxyl groups, e.g. oligomeric silicic acid, polysilicic acid, polysilicates and polyaluminiumsilicates.

The anionic stabilizer can also be selected from microparticulate material where both organic and inorganic anionic materials are encompassed. Suitable particulate materials of this type include highly cross-linked anionic vinyl addition polymers, e.g. acrylamide-based and acrylate-based polymers, anionic condensation polymers, e.g. melamine-sulfonic acid sots, inorganic silica-based materials, e.g. materials of the type present in aqueous silica based sots like silica sots, aluminated silica sots, aluminiumsilicate sols, polysilicate microgels and polyaluminiumsilicate microgels, as well as silica gels and precipitated silica. The microparticulate material preferably is colloidal, i.e. in the colloidal range of particle size. The colloidal particles suitably have a particle size from about 1 nm to about 80 nm, preferably from 2 to 35 nm and most preferably from 2 to 10 nm.

The molecular weight of the anionic compound can be varied over a broad range from a few hundreds or thousands to several millions. Usually the molecular weight is above 200 and suitably above 500, whereas the upper limit is usually 10 million and preferably 2 million. In a preferred embodiment, the molecular weight is up to about 50,000.

The amount of cationic and anionic compounds present in the dispersion according to the invention can be varied over a broad range depending on, among other things, type and charge density of the cationic and anionic materials, type of sizing agent, desired anionicity/cationicity and solids content of the resulting dispersion. The present dispersion is suitably anionic and hereby is meant that the anionic charge of the anionic stabilizer is greater that the cationic charge of the cationic compound. In the dispersion, the cationic compound can be present in an amount of up to 100% by weight, usually from 0.1 to 20% by weight, suitably from 1 to 10% by weight and preferably from 2 to 7% by weight, based on the sizing agent, and the anionic stabilizer can be present in an amount of up to 100% by weight, usually from 0.1 to 20% by weight, suitably from 0.2 to 10% by weight and preferably from 0.3 to 6% by weight, based on the sizing agent, where the overall charge of the cationic compound and the anionic stabilizer which are present in the dispersions preferably is anionic or negative.

It has been found that the present dispersions can be prepared in high solids contents and yet exhibit very good stability on storage and low viscosity. Accordingly, this invention provides size dispersions with improved storage stability, higher solids content and/or lower viscosity. A further benefit observed with the present dispersions is improved dilute stability which means less aggregation of the particles or droplets of sizing agent, thereby forming lower levels of bigger aggregates having lower sizing efficiency, as well as less deposition of the hydrophobic sizing agent on the paper machine and less wire contamination, thereby reducing the need for maintenance of the paper machine. The present dispersions generally can have sizing agent contents of from about 0.1 to about 50% by weight and suitably above 20% by weight. Dispersions containing a ketene dimer sizing agent according to the invention may have ketene dimer contents within the range of from 5 to about 50% by weight and preferably from about 10 to about 35% by weight. Dispersions, or emulsions, containing an acid anhydride sizing agent according to the invention may have acid anhydride contents within the range from 0.1 to about 30% by weight and usually from about 1 to about 20% by weight.

The sizing dispersions according to the invention can be produced by mixing an aqueous phase with the anionic stabilizer, the cationic compound and the sizing agent, preferably at a temperature where the sizing agent is liquid, and homogenizing the mixture so obtained, suitably under pressure. Suitable temperatures for ketene dimer sizing agents are from about 55° C. to 95° C. whereas lower temperatures can be employed for acid anhydrides. The obtained emulsion, which contains droplets of sizing agent normally having a size of from 0.1 to 3.5 $\mu$m in diameter, is then cooled. In addition to the above-mentioned components other materials can also be incorporated into the size dispersions, such as, for example, anionic and non-ionic dispersing agents and stabilizers, extenders, e.g. urea and urea derivatives, and preservative agents. It will be appreciated that the negative and positive charges of the compounds of the dispersant system can be formed in situ, for example by contacting the compounds with one another and/or by mixing the compounds with an aqueous phase and/or by lowering pH of the aqueous phase. For instance, the loss of a hydrogen from an acid group will form an anionic charge, and a basic amine or an amino group can be rendered cationic by protonation or abstraction of a hydrogen. Accordingly, it is possible to start with uncharged compounds in preparing the dispersion. For example, an organic compound with basic amino groups or a basic amine of the formula $R_3N$ can be used, where the corresponding ammonium moiety $R_4N^+X^-$ be formed in the preparation process, where R, N and X can be as defined above.

It has further been found that the components of the present dispersions can be easily homogenized in the presence of an aqueous phase. Usually less energy and lower shear forces are required in this process compared to processes for preparing conventional dispersions and hereby simplified equipment can be employed. Therefore, a further method of preparing the present dispersions comprises (i) mixing the cellulose-reactive sizing agent with the dispersant system comprising the anionic stabilizer and the cationic compound, as defined above, to obtain an intermediate composition, and (ii) homogenizing the intermediate composition in the presence of an aqueous phase, as described above. It is preferred that the components are homogeneously mixed in stage (i). The sizing agent used in stage (i) may be solid although it is preferred that it is liquid in order to simplify homogeneous mixing. If desired, the intermediate composition can be removed after the mixing stage (i), and optionally be cooled for solidification, to form a substantially water-free intermediate size composition which enables simplified shipping in an economically attractive manner. At the location of intended use, or elsewhere, the size composition can be homogenized in the presence of water in conventional manner. This method is especially attractive when preparing dispersions of ketene dimers and acid anhydrides, the latter of which are usually prepared in the paper mill in direct connection to its use as a sizing agent in the production of paper. The provision of a storage-stable water-free size composition thus offers considerable economic and technical benefits. The present invention thus also relates to a substantially water-free size composition comprising a cellulose-reactive sizing agent, a cationic organic compound and an anionic stabilizer, where the cationic and anionic compounds when used in combination are effective as a dispersant system for the sizing agent in an aqueous phase, its preparation and use, as further defined in the claims.

The components that are present in the composition according to the invention, i.e., the cellulose-reactive sizing agent, the cationic compound and the anionic stabilizer, preferably are as defined above. The present composition is substantially water-free and hereby is meant that a small amount of water can be present; the water content can be from 0 up to 10% by weight, suitably less than 5% by weight and preferably less than 2%. Most preferably it contains no water. The composition preferably contains the cellulose-reactive sizing agent in a predominant amount, based on weight, i.e. at least 50% by weight, and suitably the composition has sizing agent content within the range of from 80 to 99.8% by weight and preferably from 90 to 99.7% by weight. The cationic compound, preferably a surfactant, and the anionic stabilizer can be present in the size composition in amounts defined above with respect to the dispersions where the percentages are based on the weight of sizing agent. In the composition, the anionic stabilizer can be present in an amount of up to 100% by weight, usually from 0.1 to 20% by weight, suitably from 0.2 to 10% by weight and preferably from 0.3 to 6% by weight, based on the sizing agent, and the cationic compound, e.g. a surfactant, can be present in an amount of up to 100% by weight, usually from 0.1 to 20% by weight, suitably from 1 to 10% by weight and preferably from 2 to 7% by weight, based on the sizing agent, where the overall charge of the cationic compound and the anionic stabilizer that are present in the composition preferably is negative or anionic.

The dispersions according to the invention can be used in conventional manner in the production of paper using any type of cellulosic fibers and they can be used both for surface sizing and internal or stock sizing. The term "paper", as used herein, is meant to include not only paper but all types of cellulose-based products in sheet and web form, including, for example, board and paperboard. The stock contains cellulosic fibers, optionally in combination with mineral fillers, and usually the content of cellulosic fibers is at least 50% by weight, based on dry stock. Examples of mineral fillers of conventional types include kaolin, china clay, titanium dioxide, gypsum, talc and natural and synthetic calcium carbonates such as chalk, ground marble and precipitated calcium carbonate. The present invention also relates to a method for the production of paper in which an aqueous dispersion, as defined above, is used as a surface or stock size. Suitably the amount of cellulose-reactive sizing agent either added to the stock containing cellulosic fibers, and optional fillers, to be drained on a wire to form paper, or applied on the paper surface as a surface size, usually at the size press, is from 0.01 to 1.0% by weight, based on the dry weight of cellulosic fibers and optional fillers, preferably from 0.05 to 0.5% by weight, where the dosage is mainly dependent on the quality of the pulp or paper to be sized, the cellulose-reactive sizing agent used and the level of sizing desired.

The dispersions of this invention, notably the anionic dispersions, are particularly useful in stock sizing of pulp having a high cationic demand and/or containing A substantial amounts of lipophilic substances, for example stocks prepared from wood-containing and recycled pulps, for example where recirculation of white water is extensive. Examples of lipophilic substances commonly found in paper pulp include anionic and non-ionic lipophilic substances, such as, for example, resin acids, fatty acids, fatty esters, triglycerides, etc. The amount of lipophilic substances may be at least 10 ppm and up to about 100 ppm, usually at least 20 ppm, suitably at least 30 ppm and preferably at least 50 ppm, measured as ppm DCM by means of extraction using DCM (dichloromethane) in known manner. The cationic demand can be at least 50, suitably at least 100 and preferably at least 150 $\mu$eq/liter stock filtrate. The cationic demand can be measured in conventional manner, for example by means of a Mütek Particle Charge Detector using a stock filtrate obtained from a raw stock filtered through a 1.6 $\mu$m filter and poly(diallyldimethylammonium chloride) as a titrant. Further, the present dispersions are preferably used in papermaking processes where white water is extensively recirculated, i.e. with a high degree of white water closure, for example where from 0 to 30 tons of fresh water are used per ton of dry paper produced, usually less than 20, suitably less than 15, preferably less than 10 and notably less than 5 tons of fresh water per ton of paper. Recirculation of white water in the process preferably takes place by mixing the white water with cellulosic fibers, preferably in the form of a stock or suspension, before or after the addition of the sizing dispersion, e.g. to form the stock to be dewatered. Fresh water can be introduced in the process at any stage; for example, it can be mixed with cellulosic fibers in order to form the stock, and it can be mixed with a stock containing cellulosic fibers to dilute it so as to form the stock to be dewatered, before or after mixing the stock with white water and before or after the addition of the sizing dispersion.

Chemicals conventionally added to the stock in papermaking such as retention aids, aluminium compounds, dyes, wet-strength resins, optical brightening agents, etc., can of course be used in conjunction with the present dispersions.

Examples of aluminium compounds include alum, aluminates and polyaluminium compounds, e.g. polyaluminium chlorides and sulphates. Examples of suitable retention aids include cationic polymers, anionic inorganic materials in combination with organic polymers, e.g. bentonite in combination with cationic polymers, silica-based sols in combination with cationic polymers or cationic and anionic polymers. Particularly good stock sizing can be obtained when using the dispersions of the invention in combination with retention aids comprising cationic polymers. Suitable cationic polymers include cationic starch, guar gum, acrylate-based and acrylamide-based polymers, polyethyleneimine, dicyandiamide-formaldehyde resins, polyamines, polyamidoamines and poly(diallyldimethyl ammoniumchloride) and combinations thereof. Cationic starch and cationic acrylamide-based polymers are preferably used, either alone or in combination with each other or with other materials. In a preferred embodiment of the invention, the dispersions are used in combination with a retention system comprising at least one cationic polymer and anionic silica-based particles. The present dispersions can be added before, between, after or simultaneously with the addition of the cationic polymer or polymers. It is also possible to pre-mix the size dispersion with a retention aid, e.g. a cationic polymer like cationic starch or a cationic acrylamide-based polymer, or an anionic silica-based material, prior to introducing the mixture thus obtained into the stock. Accordingly, the dispersion can be prepared just prior to introducing it into the stock by bringing into contact a size dispersion containing the cationic compound, preferably a cationic surfactant, with an anionic silica-based material, for example as defined above.

The invention is further illustrated in the following examples, which, however, are not intended to limit the same. Parts and % relate to parts by weight and % by weight, respectively, unless otherwise stated.

EXAMPLE 1

Anionic alkyl ketene dimer (AKD) dispersions according to the invention were prepared by mixing di(hydrogenated tallow) dimethylammonium chloride, which is a cationic surfactant commercially available under the trade name Querton 442, Akzo Nobel, with molten AKD at 70° C., passing the mixture through a homogenizer in the presence of an aqueous solution of an anionic stabilizer and then cooling the dispersion so obtained. The pH of the dispersion was adjusted to about 5 by addition of acid. The anionic stabilizer used in this Example was an anionic fatty amide-modified carboxymethyl cellulose (FACMC) containing a hydrophobic substituent derived from N-hydrogenated tallow-1,3-diaminopropan prepared according to the disclosure of WO 94/24169. The FACMC had a degree of carboxylic substitution of 0.6 and a degree of hydrophobic substitution of 0.1. The dispersions contained AKD particles with an average particle size of about 1 μm which were anionically charged, as shown by a negative zeta potential determined by means of a ZetaMaster S Version PCS. The AKD content of the dispersions were 30%. Dispersion No. 1 contained 3% of cationic surfactant and 1% of anionic stabilizer, both based on the weight of AKD. Dispersion No. 2 contained 7% of cationic surfactant and 1% of anionic stabilizer, both based on the weight of AKD.

EXAMPLE 2

The general procedure of Example 1 was repeated except that a condensated sodium naphthalenesulphonate commercially availably under the trade name Orotan™ SN, Rohm & Haas Company, was used as the anionic stabilizer and different proportions of the compounds of the dispersion was employed. Dispersion No. 3 obtained in this Example had an AKD content of 30% and contained 6% of anionic stabilizer and 4% of cationic surfactant, both based on the weight of AKD. The dispersion contained AKD particles with an average particle size of about 1 μm which were anionically charged, determined as above.

EXAMPLE 3

Stability of the anionic dispersions according to Examples 1 and 2 was tested as follows: The dispersion was diluted with water to give a dispersion containing 40 ppm of AKD. In some of the tests 10 ppm of stearic acid was added in order to raise the content of lipophilic substances and the cationic demand. The dilute dispersion was placed in a jar equipped with a device for turbidity measurements, a loop, circulation means and heating and cooling means. A set volume of the dilute dispersion was circulated in the loop while automatically recording the turbidity and subjecting the dispersion to a heating and cooling cycle for a set time period of 45 minutes. The temperature of the dispersion was raised from 20° C. to 62° C. and then lowered again to 20° C. Turbidity is affected by particle size and the difference in turbidity of the dispersion before and after a temperature cycle is a measure of the ability of the dispersed particles to withstand growth by agglomeration and thus a measure of the stability of the dispersion. The difference in turbidity (ΔT) is calculated as follows: ΔT=(final turbidity/initial turbidity)×100. The higher the ΔT the better the stability.

Two standard dispersions were also tested for comparison purposes; Ref. 1 is an anionic AKD dispersion containing a dispersant system comprising sodium lignosulphonate and cationic starch where the lignosulphonate is present in ionic excess; Ref. 2 is a cationic AKD dispersion also containing sodium lignosulphonate and cationic starch but where the cationic starch is present in ionic excess. Table 1 gives the results obtained.

TABLE 1

| Dispersion No. | Stearic acid [ppm] | ΔT |
|---|---|---|
| 1 | — | 53 |
| 1 | 10 | 40 |
| 2 | — | 79 |
| 2 | 10 | 66 |
| 3 | — | 72 |
| 3 | 10 | 55 |
| Ref. 1 | — | 45 |
| Ref. 1 | 10 | 32 |
| Ref. 2 | — | 35 |
| Ref. 2 | 10 | 6 |

As is shown in Table 1 the ΔT values of the dispersions of this invention were considerably higher than those of the standard dispersions which accordingly are indicative of better dilute stability.

EXAMPLE 4

Sizing efficiency of size dispersions according to Example 3 was evaluated in this Example. Paper sheets were prepared according to the standard method SCAN-C23X for laboratory scale. The papermaking stock used contained 80% of 60:40 bleached birch/pine sulphate and 20% of chalk to which 0.3 g/l of $Na_2SO_4.10H_2O$ was added. Stock consistency was 0.5% and pH 8.0. The size dispersions were used in conjunction with a commercial retention and dewatering system, Compozil™, comprising cationic starch and an anionic aluminium-modified silica sol which were added to the stock separately; the cationic starch was added in an amount of 8 kg/ton, based on dry stock, and the silica sol was added in an amount of 0.8 kg/ton, calculated as $SiO_2$ and based on dry stock Cobb values, measured according to TAPPI standard T 441 OS-63, obtained in the tests are set forth in Table 2. The dosage of AKD is based on dry stock.

TABLE 2

| Dispersion No. | AKD dosage [kg/ton] | Cobb 60 [g/m$^2$] |
|---|---|---|
| 1 | 0.45 | 54 |
| 1 | 0.60 | 27 |
| Ref. 1 | 0.45 | 80 |
| Ref. 1 | 0.60 | 30 |
| Ref. 2 | 0.45 | 68 |
| Ref. 2 | 0.60 | 31 |

Table 2 demonstrates the improvement in paper sizing obtained with the size dispersion according to the invention.

EXAMPLE 5

Sizing efficiency was evaluated according to the procedure of Example 4 except that the stock contained precipitated calcium carbonate as a filler instead of chalk, and the dosage of cationic starch was 12 kg/ton, based on dry stock. In some of the tests 10 ppm of stearic acid was added to the stock in order to raise the the cationic demand and the liphophilic substance content of the stock. The results are set forth in Table 3.

TABLE 3

| Dispersion No. | AKD dosage [kg/ton] | Stearic acid [ppm] | Cobb 60 [g/m$^2$] |
|---|---|---|---|
| 1 | 0.45 | — | 32 |
| 1 | 0.60 | — | 28 |
| 1 | 0.75 | — | 26 |
| 1 | 0.45 | 10 | 62 |
| 1 | 0.60 | 10 | 36 |
| 1 | 0.75 | 10 | 27 |
| Ref. 1 | 0.45 | — | 50 |
| Ref. 1 | 0.60 | — | 32 |
| Ref. 1 | 0.75 | — | 30 |
| Ref. 1 | 0.45 | 10 | 103 |
| Ref. 1 | 0.60 | 10 | 76 |
| Ref. 1 | 0.75 | 10 | 35 |

As is evident from Table 3, Dispersion No. 1 according to the invention generally gave much better sizing than the dispersion Ref. 1 used for comparison, and considerably improved sizing effect was obtained when the stock contained a substantial amount of lipophilic substances.

EXAMPLE 6

A water-free size composition according to the invention was prepared by dry mixing 93 parts of AKD pellets with 3 parts of cationic surfactant according to Example 1 and 4 parts of anionic stabilizer according to Example 2. This dry mixture was later added to hot water and the aqueous mixture so obtained was heated to 80° C., pumped through a high shear pump and then cooled to room temperature. The resulting anionic dispersion, Dispersion No. 4, had an AKD content of 20% and an average particle size of about 1 $\mu$m. Sizing efficiency was evaluated as in Example 4, except that the cationic starch addition amounted to 12 kg/ton, based on dry stock. The results are given in Table 4.

TABLE 4

| Dispersion No. | AKD dosage [kg/ton] | Cobb 60 [g/m$^2$] |
|---|---|---|
| 4 | 0.30 | 58 |
| 4 | 0.40 | 30 |
| Ref. 1 | 0.30 | 84 |
| Ref. 1 | 0.40 | 85 |
| Ref. 2 | 0.30 | 66 |
| Ref. 2 | 0.40 | 40 |

Table 4 demonstrates the improvement in paper sizing obtained with the size dispersion according to the invention.

EXAMPLE 7

An AKD dispersion according to the invention having a dispersant system comprising a cationic surfactant and an anionic stabilizer in the form of an inorganic microparticulate material was evaluated in this test series.

The dispersion was prepared by preblending at 75° C. 0.2 g of cocoamine commercially available under the trade name Armeen C™, which is a mixture of amines of the formula $RNH_2$ wherein R is $C_{12}$–$C_{18}$ hydrocarbons, and 1.0 g, calculated as $SiO_2$, of an aqueous sol of aluminium-modified silica of the type disclosed in U.S. Pat. No. 5,368,833, and then adding 25 g of AKD and acid to adjust pH to 4.0. The aqueous mixture was homogenized using an Ultra Turrax and then cooled. The dispersion obtained, Dispersion No. 5, had an AKD content of 25% by weight and contained a dispersant system which was anionic in nature.

Sizing efficiency of the dispersion was evaluated according to the procedure of Example 4 using a similar stock at pH 8.1 and using the standard AKD dispersion Ref. 2 for comparison. The results are set forth in Table 5 where the dosage of AKD is based on dry stock.

TABLE 5

| Dispersion No. | AKD dosage [kg/ton] | Cobb 60 [g/m$^2$] |
|---|---|---|
| 5 | 0.3 | 58 |
| 5 | 0.5 | 30 |
| 5 | 0.6 | 28 |
| Ref. 2 | 0.3 | 73 |
| Ref. 2 | 0.5 | 33 |
| Ref. 2 | 0.6 | 30 |

EXAMPLE 8

An AKD dispersion according to the invention was prepared and evaluated in a similar manner to Example 7 except that the anionic stabilizer used in this Example was a melamine-sulfonic acid sol, prepared in accordance with the teachings of Int. Pat. Appl. Publ. No. WO 96/34027. Dispersion No. 6 was prepared from 0.4 g of cocoamine, 2 g of melamine-sulfonic acid, 30 g of AKD and water up to 100 g. The results of the sizing tests are shown in Table 6 where the dosage of AKD is based on dry stock.

TABLE 6

| Dispersion No. | AKD dosage [kg/ton] | Cobb 60 [g/m$^2$] |
|---|---|---|
| 6 | 0.4 | 39 |
| 6 | 0.5 | 28 |
| 6 | 0.6 | 22 |
| Ref. 2 | 0.4 | 50 |

TABLE 6-continued

| Dispersion No. | AKD dosage [kg/ton] | Cobb 60 [g/m$^2$] |
|---|---|---|
| Ref. 2 | 0.5 | 35 |
| Ref. 2 | 0.6 | 25 |

EXAMPLE 9

Ease of manufacture of dispersions according to the invention was evaluated by preparing anionic AKD dispersions at different AKD contents. Dispersions of the invention were prepared by homogenising a mixture of 0.8% by weight of di(hydrogenated tallow)dimethylammonium chloride, 1.6% by weight of condensated sodium naphthalene-sulphonate, 77.6% by weight of water and 20% by weight of AKD for a set time using an Ultra Turrax mixer at 15.000 rpm and then cooling the dispersion so obtained for 2 hours. Similar dispersions were prepared in the same manner at different AKD contents in order to provide dispersions with AKD contents of 10, 20, 30 and 40% by weight. The dispersions are denoted Inv. followed by the AKD content in % by weight.

Standard AKD dispersions were manufactured for comparison purposes in the same manner and under the same conditions by homogenising a mixture of 1.0% by weight of cationic starch, 0.25% by weight of sodium lignosulfonate, 89% by weight of water and 10% by weight of AKD. Similar dispersions were prepared at different AKD contents in order to provide standard dispersions with AKD contents of 10, 20, 30 and 40% by weight. The dispersions are denoted Ref. 3 followed by the AKD content in % by weight.

Particle size and viscosity were assessed in conventional manner. Table 7 shows the results obtained.

TABLE 7

| AKD Dispersion No. | Particle size ($\mu$m) | Viscosity (cps) |
|---|---|---|
| Inv. - 10% | 2.98 | 10 |
| Inv. - 20% | 3.12 | 20 |
| Inv. - 30% | 3.50 | 20 |
| Inv. - 40% | 3.50 | 25 |
| Ref. 3 - 10% | 4.31 | 15 |
| Ref. 3 - 20% | 4.52 | 20 |
| Ref. 3 - 30% | 5.20 | 25 |
| Ref. 3 - 40% | 5.57 | 40 |

Table 3 demonstrates that the dispersions according to the invention were easier to manufacture; a lower viscosity was obtained at corresponding AKD contents and a smaller particle size was obtained using the same amount of energy to set surfaces free. Compared to the standard dispersion, less energy and lower shear forces are thus required according to this invention in order to manufacture dispersions with equal particle size. In addition, an increase in stirrer speed to 25.000 rpm considerably reduced the particle size of the dispersions according to the invention to be within the range of from 1 to 2 $\mu$m.

We claim:

1. Aqueous dispersion of a sizing agent containing a cellulose-reactive sizing agent and a dispersant system comprising a low weight average molecular weight cationic organic compound having a molecular weight of less than 10,000 and an anionic stabilizer which is an anionic polyelectrolyte.

2. The dispersion of claim 1, wherein the cationic organic compound is a cationic surfactant.

3. The dispersion of claim 2, wherein the cationic surfactant contains at least one hydrocarbon group with from 9 to 30 carbon atoms.

4. The dispersion of claim 2, wherein the cationic surfactant is selected from the group consisting of dioctyldimethylammonium chloride, didecyldimethylammonium chloride, dicocodimethylammonium chloride, cocobenzyldimethylammonium chloride, coco(fractionated) benzyldimethylammonium chloride, octadecyl trimethylammonium chloride, dioctadecyl dimethylammonium chloride, dihexadecyl dimethylammonium chloride, di(hydrogenated tallow)dimethylammonium chloride, di(hydrogenated tallow)benzylmethylammonium chloride, (hydrogenated tallow)benzyldimethylammonium chloride, dioleyldimethylammonium chloride, di(ethylene hexadecanecarboxylate) dimethylammonium chloride, N-octadecyl-N-dimethyl-N'-trimethyl-propylene-diammonium dichloride, and mixtures thereof.

5. The dispersion of claim 1, wherein the anionic stabilizer is an organic polyelectrolyte.

6. The dispersion of claim 1, wherein the anionic stabilizer is selected from the group consisting of anionic polyurethanes, condensated naphthalene sulphonates, anionic polysaccharides, anionic vinyl addition polymers, optionally being copolymerized with non-ionic monomers, anionic organic microparticulate materials, and mixtures thereof.

7. The dispersion of claim 1, wherein the anionic stabilizer is a silica-based material.

8. The dispersion of claim 1, wherein the dispersion is anionic.

9. The dispersion of claim 1, wherein the sizing agent is a ketene dimer or an acid anhydride.

10. The dispersion of claim 1, wherein the sizing agent comprises a ketene dimer sizing agent, the cationic organic compound comprises a cationic surfactant, and the anionic stabilizer is selected from the group consisting of anionic organic compounds and anionic silica-based materials.

11. A method for the preparation of an aqueous dispersion of a cellulose-reactive sizing agent which comprises homogenizing a cellulose-reactive sizing agent in the presence of an aqueous phase and a dispersant system wherein said dispersant system comprises a low weight average molecular weight cationic organic compound having a molecular weight less than 10,000 and an anionic stabilizer which is an anionic polyelectrolyte.

12. The method of claim 11, wherein the cationic organic compound is a cationic surfactant and the sizing agent is a ketene dimer or an acid anhydride.

13. The method of claim 11, wherein the cationic organic compound is derived from an uncharged organic polymer with basic amino groups or from a basic amine, the cationic organic compound being formed from said uncharged organic polymer with basic amino groups or from said basic amine in the method.

14. The method of claim 11, which comprises providing a substantially water-free composition containing the cellulose-reactive sizing agent, the cationic organic compound and the anionic stabilizer, and homogenizing the composition in the presence of an aqueous phase.

15. Aqueous dispersion of a ketene dimer sizing agent which comprises a dispersant system comprising a cationic surfactant having a weight average molecular weight between about 200 and about 800 and an anionic stabilizer which is an anionic polyelectrolyte.

16. The dispersion of claim 15, wherein the cationic surfactant contains at least one hydrocarbon group having from 9 to 30 carbon atoms.

17. The dispersion of claim 15, wherein the anionic stabilizer is an organic compound.

18. The dispersion of claim 15, wherein anionic stabilizer is selected from the group consisting of anionic condensation polymers, condensated naphthalene sulphonates, anionic polysaccharides, anionic vinyl addition polymers and mixtures thereof.

19. The dispersion of claim 15, wherein the anionic stabilizer is an inorganic silica-based material.

20. The dispersion of claim 15, wherein the dispersion is anionic.

21. The dispersion of claim 15, wherein cationic surfactant is present in an amount of from 0.1 to 20% by weight, based on the sizing agent, and the anionic stabilizer is present in an amount of from 0.1 to 20% by weight, based on the sizing agent.

* * * * *